US006454009B2

(12) United States Patent
Carmichael et al.

(10) Patent No.: US 6,454,009 B2
(45) Date of Patent: Sep. 24, 2002

(54) APPARATUS AND METHOD FOR CLEANING WELL RISERS

(76) Inventors: Mark Carmichael, Douet Duret, St. Mary, Jersey JE3 3RF (GB); Paul David Howlett, 234 North Daeside Road, Cults, Aberdeen AB15 9P8 (GB)

( * ) Notice: Subject to any disclaimer, the term of this patent is extended or adjusted under 35 U.S.C. 154(b) by 0 days.

(21) Appl. No.: 09/753,545

(22) Filed: Jan. 3, 2001

Related U.S. Application Data

(63) Continuation-in-part of application No. 09/093,599, filed on Jun. 9, 1998, now abandoned.

(51) Int. Cl.[7] ..... E21B 37/00

(52) U.S. Cl. ..... 166/311; 166/169; 166/334.4; 134/167 C; 134/169 C

(58) Field of Search ..... 166/312, 311, 166/334.4, 222, 169, 301, 367; 134/167 C, 169 C, 172, 174

(56) References Cited

U.S. PATENT DOCUMENTS 4,162,691 A * 7/1979 Perkins ..... 137/613
4,466,487 A * 8/1984 Taylor, Jr. ..... 166/339
5,195,585 A 3/1993 Clemens et al.
5,564,500 A 10/1996 Rogers et al.
5,803,177 A 9/1998 Hriscu et al.
6,065,541 A * 5/2000 Allen ..... 166/318

FOREIGN PATENT DOCUMENTS

GB 2272923 1/1994
WO WO-9313292 A1 * 7/1993

* cited by examiner

*Primary Examiner*—David Bagnell
*Assistant Examiner*—Zakiya Walker
(74) *Attorney, Agent, or Firm*—RatnerdPrestia

(57) ABSTRACT

The present invention is directed to a method of cleaning a well riser. In particular, the method comprises the steps of suspending in a drill pipe from the surface a circulating tool in the well riser, and causing the circulating tool to axially collapse so as to open one or more radial outlets in the tool and allow cleaning fluid to be expelled out of the tool and impact on the inside of the well riser.

9 Claims, 2 Drawing Sheets

APPARATUS AND METHOD FOR CLEANING WELL RISERS

RELATED APPLICATIONS

Figure 1:
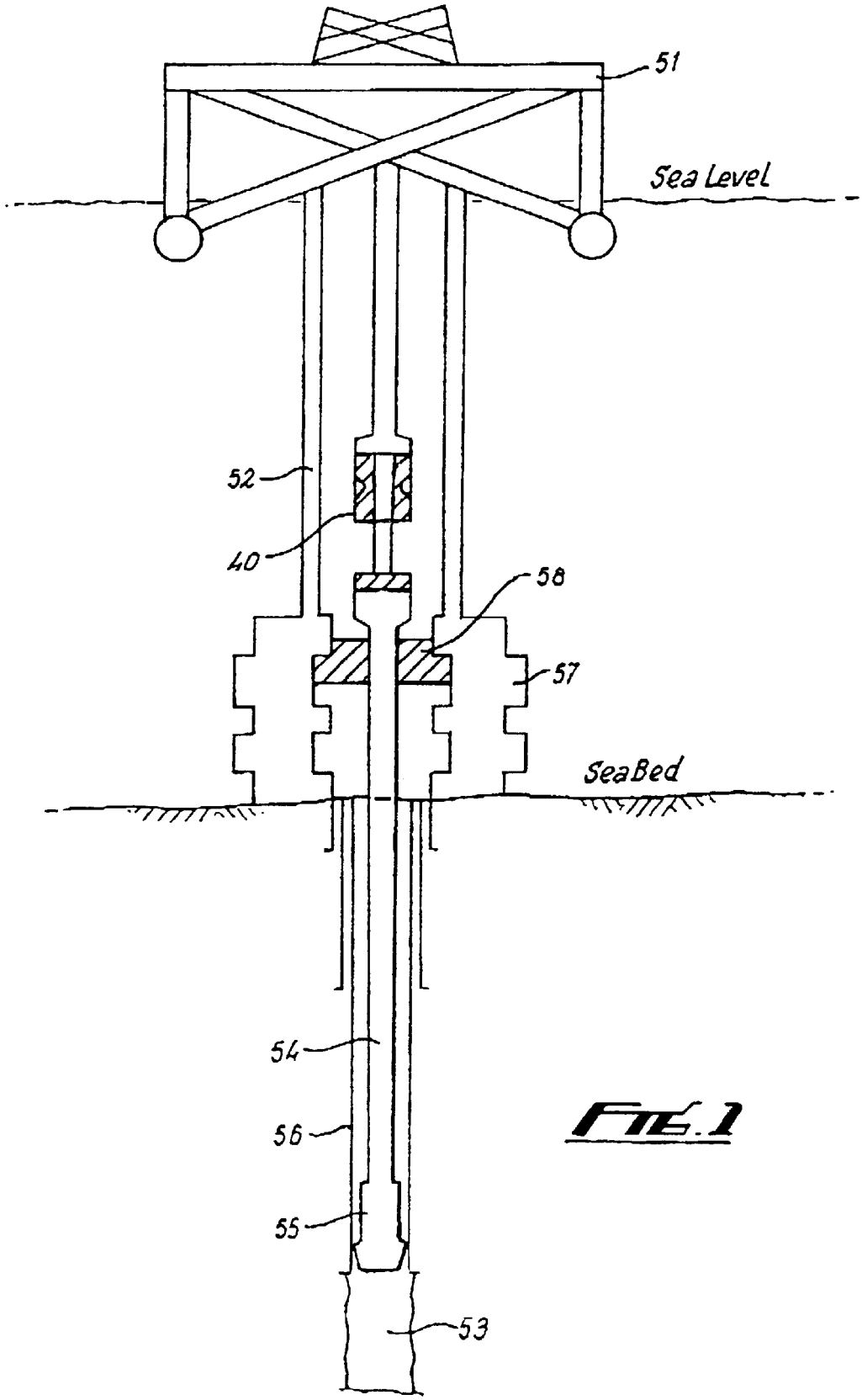

This application is a continuation-in-part of U.S. application Ser. No. 09/093,599, inventors Michael Carmichael and Paul D. Howlett, entitled, APPARATUS AND METHOD FOR CLEANING WELL RISERS, filed Jun. 9, 1998, now abandoned.

This invention relates to apparatus for circulating fluid and in particular, apparatus for circulating fluid in a well riser, and to a method of cleaning same using the apparatus.

A number of forms of cleaning equipment or apparatus are known for cleaning out the inside of a well casing or liner to wash away any debris or other contaminants. However, apparatus and method suitable for cleaning well risers above the seabed are less common and generally unsatisfactory. This, in part, is because of the relatively large internal diameter of typical risers, rendering most known equipment impractical for this purpose.

One type of clean-up apparatus is known as a circulating tool. This apparatus relies on the use of high flow rates to create turbulence to aid the cleaning out process.

In British Patent Number 2,272,923, there is described a multifunction circulating tool. The tool has an axial through passage between an inlet and a first outlet, the inlet and the first outlet being adapted for connection in a drill string supported from the surface, a second outlet extending generally transversely of the apparatus, wherein the apparatus includes an obturating member movable between a first position closing the second outlet and a second position permitting fluid flow through the second outlet; and in which the apparatus is associated with a shoulder engageable with a shoulder portion in the borehole.

Typically, said formation in the borehole is defined by the top edge of a liner within the borehole and the shoulder is connected to the obturating member. However, the application of the top edge of the liner as the formation is not entirely or always suitable when it is desired to flush or is clean the well riser.

An object of the present invention therefore is to provide a method for using this known circulating tool to clean well risers.

According to the present invention there is provided a method of cleaning a well riser, the method comprising suspending in a drill string from surface a circulating tool in the well riser, and causing the circulating tool to axially collapse so as to open one or more radial outlets in the tool and allow cleaning fluid to be expelled out of the tool and impact on the inside of the well riser.

Typically the well riser is provided with blow out preventers incorporating drill string rams and the circulating tool is caused to axially collapse by closing the drill string rams around the drill string below the circulating tool and slacking off sufficient drill string weight to hang the drill string and collapse the tool.

Alternatively, the tool may be provided with a shoulder which co-operates with a formation in the well riser to allow for the slacking off of sufficient drill pipe weight to hang the pipe and collapse the tool.

The method may further include passing the cleaning fluid down the drill string to an inlet of the apparatus and thence via a first outlet communicating with the drill string below the circulating tool before setting down the weight of the drill string.

The method may be employed after drilling or milling is complete and include pulling the drill pipe upward and out of a well bore until the tool is above the drill pipe rams.

According to a second aspect of the present invention there is provided a circulating tool for cleaning well risers, the tool comprising a generally axial body having an axial through passage between an inlet and a first outlet, the inlet and the first outlet being adapted for connection in a drill string supported from the surface, a second outlet extending generally transversely of the tool, wherein the tool further includes an obturating member movable between a first position closing the second outlet and a second position permitting fluid flow through the second outlet.

The drill string may be provided with a shoulder for cooperating with a formation in the well bore or riser. The shoulder may be provided as part of the circulating tool.

Preferably, the second outlet comprises a number of apertures in a body member which communicate with the inlet and typically, the apertures may be distributed circumferentially around the outer surface of the body member.

Typically, the cross-sectional area of the first outlet is greater than the cross-sectional area of the second outlet.

Preferably, the second outlet is designed to communicate with the apertures in the sleeve irrespective of the circumferential orientation of the sleeve with respect to the second outlet. This could be designed by providing a circumferentially extending groove on the inside of the obturating member which aligns with the second outlet when the second outlet is open.

Figure 2:
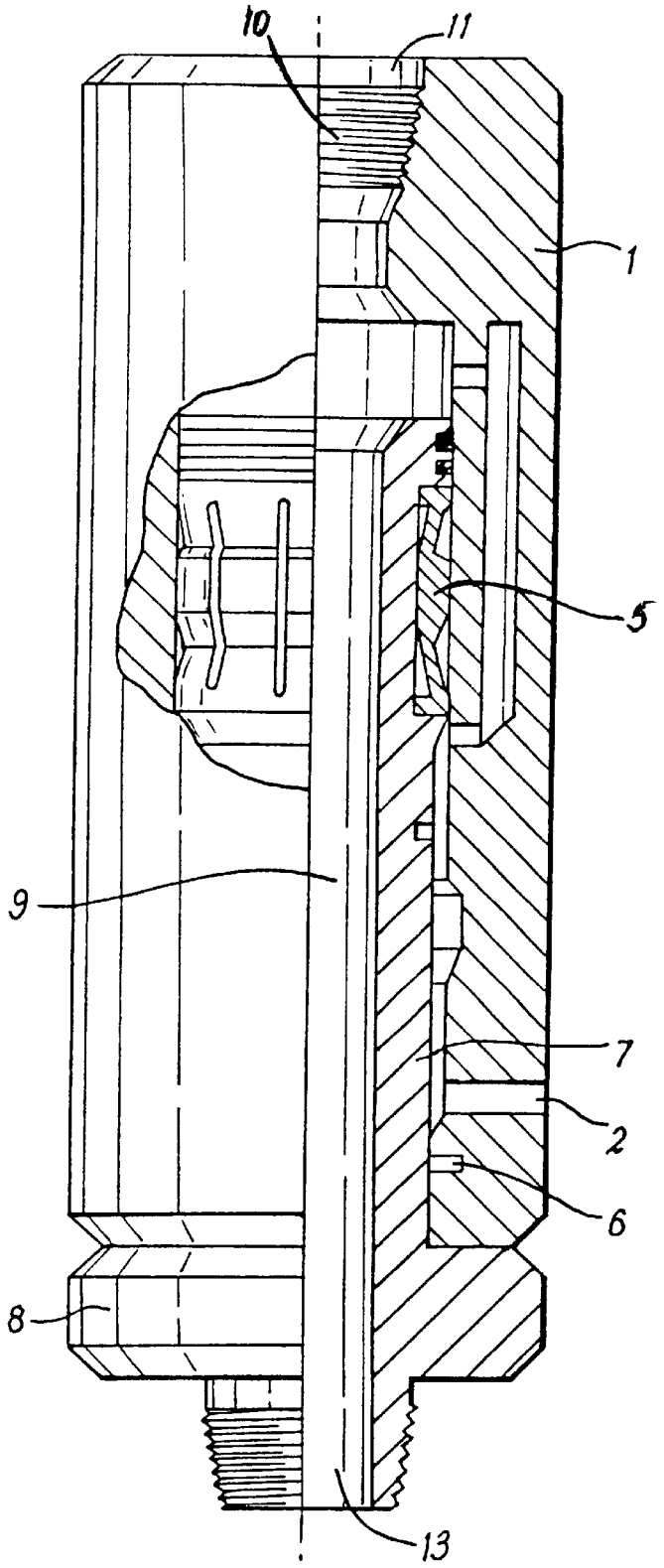

An example embodiment and method within the scope of the invention will now be described in order to better portray the invention and with reference to the accompanying drawings, in which:

FIG. 1 is a schematic illustration of a drill pipe hung off drill pipe rams in a well riser; and FIG. 2 shows, also as a partial cross-sectional view, the tool of FIG. 1 in a collapsed state;

Referring firstly to FIG. 1, there is depicted an off-shore oil rig 51 located above a well riser 52 and a wellbore 53. Inserted in the well riser 52 and wellbore 53, is a drill string 54 having a drilling bit 55 located at its extremity. A casing string 56 is located also in the wellbore.

The well riser 52 is provided with blow out preventers 57. Associated with the blow out preventers 57 are drill pipe rams 58 which provide an opening and closing function around the drill string 54.

Within the drill string 54, is provided a multi-function circulating tool 40. The tool is formed largely of an upper and lower part wherein the two parts may collapse and open in an axial direction relative to each other. When the tool 40 is in its axially extended or open state, fluid may circulate axially down the drill string including through the tool. When the tool 40 is in a collapsed state, a second and radial outlet opens such that circulating or cleaning fluid can additionally pass in a generally radial or transverse direction toward the well tubing.

In order to use the multi-function circulating tool 40 to jet cleaning fluid on the well riser 52 during a drilling or wellbore clean-up operation, the following method may be employed.

The drill string 54 comprising drilling equipment is run in the hole. Depending on the depth of the bore which has been lined with casings and the length of the well riser, the multi-function circulating tool 40 is positioned to be at or above the blow out preventers 57 when the bottom of the drill string 54 is inside the casing shoe.

After drilling or milling is complete or it is otherwise desired to jet the well riser 52, the drill string is pulled upwardly or retracted at the hole until the multi-function circulating tool 40 is above the drill string rams 58 inside the blow out preventers 57. At this point, the drill bit 55 is inside the casing shoe.

The drill pipe rams 58 may then be closed around the drill pipe 54 below the multi-function circulating tool 40. The weight of the drill string is then slackened off such that the drill string is hung off the rams 58. Additional weight may be slackened off such that a shear ring or shear pin or similar means within the multi-function circulating tool may be sheared or overcome to cause the tool 40 to collapse. The collapse of the tool 40 brings about the opening of the second or radial outlets in the tool 40 and accordingly radial or transverse circulation of fluid onto the inside walls of the well riser 52 may commence.

After jetting and circulating is complete, pumping of circulation fluid may cease and the drill string may be picked up to close the second outlet of the multi-function circulation tool 40. Before opening the rams 58, the well should be monitored. The weight of the drill string 54 may then be picked up and the ram 58 and blow out preventers 57 may be opened.

Thereafter, the drill string 54 may be run back in the hole and further drilling or other operation may be undertaken, if desirable.

It will be appreciated by persons skilled in the art that the function of the string in which the tool 40 is located is not an essential element of the present invention. For example, the string could be used for drilling, milling or for performing a wellbore clean-up or well riser operation.

Turning now to FIG. 2, there is depicted a circulation tool comprising a body member 1 defining an internal fluid flow path in the form of an axial bore 9.

Slidably mounted within the throughbore 9 is an obturating member 7. The obturating member 7 is also provided with an axial flow path 10 therethrough which co-ordinates with the body member 1 to provide a generally axial circulation path for fluid between the inlet 11 and a first outlet 13.

The body 1 is provided with a plurality of circumferentially spaced radial ports 2 which provide a second outlet for circulating fluid. However, when the tool 40 is in the state shown in FIG. 2 hereto, the second outlet 2 is open and the flow path through the tool is from the inlet 11 and out the first and second outlets 13, 2.

In use, the back-pressure of the annulus of the string below the tool serves to ensure that substantially all of the fluid flows out the outlet 2.

The obturating member 7 is provided with a shoulder 8 suitable for landing on a formation in the well bore or riser. For example, the shoulder 8 may be suitably sized to land on the top end of a blow out preventer.

A shear ring 6 provides a connecting means between the body 1 and the obturating member 7. When the shear ring 6 is intact, the tool is held in a first or expanded position with the obturating member 7 obturating the second outlet 2.

One or more collets 5 may also be provided in respective seats in the obturating member 7; the collets 5 engaging respective cavities in the body 1.

It should be noted that the tool is suitable for attachment in a drill string; there being a female connector provided near the inlet 11 and a male connector provided in the vicinity of the first outlet 13.

A pressure operated valve could be coupled to the first outlet 13 to positively isolate the lower length of drill string from the through bore 9 and ensure all fluid flow is out of outlet 2, when the tool is in the collapsed state.

First outlet 13 is preferably not closed during operation because it is not necessary to close the first outlet 13 to divert flow out of outlet 2. This is because the drill, as shown in FIG. 2, has a long string of pipe below the tool. Thus, back pressure inside the drill string 54 is greater than the pressure outside the drill string 54, i.e. outlet 2. Therefore, when the tool is in the collapsed state, outlet 2 and outlet 13 are open and in use. Most of the fluid will flow out of the outlet 2. However, the flow path can be blocked, (at least partially), or obturated by expanding the tool, wherein at least a portion of the fluid is required to flow through the axial bore 9 and out the outlet 13.

Further modifications and improvements may be incorporated without departing from the scope of the invention herein intended.

What is claimed:

1. A method of cleaning a well riser, the riser being provided with a blow out preventer incorporating drill pipe rams, wherein the method comprises the steps of suspending from a surface in a drill pipe a circulating tool in the well riser, causing the tool to axially collapse by closing the drill pipe rams around the drill pipe below the circulating tool and slacking off sufficient drill pipe weight to hang the drill pipe and collapse the circulating tool, whereby collapsing of the circulating tool serves to open one or more radial outlets in the circulating tool, allowing a cleaning fluid to be expelled out of the circulating tool and impact on the side of the well riser.

2. A method in accordance with claim 1 further including the steps of passing the cleaning fluid down a drill string to an inlet of the circulating tool and thence via a first outlet communicating the drill string below the circulating tool before setting down the weight of the drill string.

3. A method as claimed in claim 1 employed after drilling or milling is complete wherein the method further includes the step of pulling the drill pipe upward and out of a well bore until the circulating tool is above the drill pipe rams.

4. A circulating tool for cleaning a well riser disposed below a water surface but above a well bore, the tool comprising a generally axial body having an axial through passage between an inlet and a first outlet, the inlet and the first outlet being adapted for connection in a drill string supported from the surface, a second outlet extending generally transversely of the tool, wherein the tool further includes an obturating member movable between a first position closing the second outlet when the tool is in an expanded state and a second position permitting fluid flow through the second outlet when collapsed, wherein the obturating member includes one or more collets for engaging respective one or more cavities in the body when the tool is in said expanded state.

5. A circulating tool as claimed in claim 4 in combination with the drill string wherein the drill string is provided with a shoulder for co-operating with a formation in the well bore or riser.

6. A circulating tool as claimed in claim 4 wherein the tool is provided with a shoulder for co-operating with a formation in the well bore or riser.

7. A circulating tool as claimed in claim 4 wherein the second outlet comprises a number of apertures in a body member which communicate with the inlet and the apertures are distributed circumferentially around the outer surface of the body member.

8. A system for cleaning a well riser disposed below a water surface but above a well bore, the system comprising:

(a) a circulating tool comprising a generally axial body having an axial through passage between an inlet and a first outlet, the inlet and the first outlet being adapted for connection in a drill string supported from the surface, a second outlet extending generally transversely of the tool, wherein the tool further includes an obturating member movable between a first position closing the second outlet when the tool is in an expanded state and a second position permitting fluid flow through the second outlet when collapsed, wherein the obturating member includes one or more collets for engaging respective one or more cavities in the body when the tool is in said expanded state; and (b) a drill string having a shoulder for cooperating with a formation in the well bore or riser.

9. A circulating tool for cleaning a well riser disposed below a water surface but above a well bore, the tool comprising a generally axial body having an axial through passage between an inlet and a first outlet, the inlet and the first outlet being adapted for connection in a drill string supported from the surface, a second outlet extending generally transversely of the tool, wherein the tool further includes an obturating member movable between a first position closing the second outlet when the tool is in an expanded state and a second position permitting fluid flow through the second outlet when collapsed, wherein the obturating member includes one or more collets for engaging respective one or more cavities in the body when the tool is in said expanded state;

wherein said tool has a shoulder cooperating with a formation in the well bore or riser.

* * * * *